United States Patent [19]

Shorthill et al.

[11] Patent Number: 4,934,019

[45] Date of Patent: Jun. 19, 1990

[54] CLEANER LATCH ARRANGEMENT

[75] Inventors: Robert C. Shorthill, Canton; Gerald L. Melegari, North Canton, both of Ohio

[73] Assignee: The Hoover Company, North Canton, Ohio

[21] Appl. No.: 335,427

[22] Filed: Apr. 10, 1989

[51] Int. Cl.[5] ..... A47L 9/14

[52] U.S. Cl. ..... 15/327 F; 15/339; 220/326

[58] Field of Search ..... 15/327 R, 327 E, 327 F, 15/339, 347, 352; 220/324, 326

[56] References Cited

U.S. PATENT DOCUMENTS

| | | | |
|---|---|---|---|
| 2,450,544 | 10/1948 | Foley | 285/173 |
| 2,755,106 | 7/1956 | Brennan et al. | 285/7 |
| 2,978,732 | 4/1961 | Hansen | 15/327 R X |
| 2,998,864 | 9/1961 | Gaudry | 183/43 |
| 3,259,268 | 7/1966 | Anderson | 220/326 |
| 3,438,081 | 4/1969 | Ruzzier | 15/327 R |
| 3,564,641 | 2/1971 | Meyer | 15/327 E X |
| 4,545,794 | 10/1985 | Himukai | 15/327 E X |

FOREIGN PATENT DOCUMENTS

| | | | |
|---|---|---|---|
| 752088 | 2/1967 | Canada | 15/327 R |
| 770839 | 11/1967 | Canada . | |
| 1039033 | 8/1966 | United Kingdom . | |

*Primary Examiner*—Chris K. Moore

[57] ABSTRACT

The invention comprehends a pair of latching arrangements for a vacuum cleaner bag door. The latching arrangements each consist of an operator button and an urging spring, with the urging spring including the latching hook. These two elements are assembled in the bag door lid in a captivating condition with each other and maintained therein by one way locking barbs.

10 Claims, 6 Drawing Sheets

CLEANER LATCH ARRANGEMENT

BACKGROUND OF THE INVENTION

1. Field of the Invention

This invention relates to floor care appliances and, more particularly, relates to latching arrangements for bag door lids or the like on canister vacuum cleaners.

2. Summary of the Prior Art

Latching arrangements utilized in cleaners for locking bag lid latches or the like are old and well known. Some of these latches require separate pin mounting of the latches and separate operating buttons while some utilize end tabs for mounting engagement with the cleaner and an integral button portion, spring urged to extend through the bag lid. However, these latches are either difficult to mount or, alternately, not terribly secure in their mounting. Accordingly, it would be advantageous to provide a bag latch arrangement that was both secure and easily assembled.

Accordingly, it is an object of this invention to provide securely but easily mounted latch assemblies.

It is a further object of this invention to provide latch pieces and springs which, when mounted to the cleaner bag lid, are securely captivated therein.

It is an additional object of the invention to provide a means for locking each of the latch buttons and latch springs securely together when mounted to the bag lid.

It is a further object of the invention to provide one way locking barbs on the latch buttons for easy assembly and secure mounting with their springs and bag lids.

SUMMARY OF THE INVENTION

The invention provides a pair of latching arrangements for a hinged bag lid door or the like that are captivated in the lid after mounting to provide a secure latching system for the cleaner in which they are installed.

Each of the latch arrangements utilizes a button actuator that is mounted downwardly through an aperture in the top of the shell form of the bag lid. Disposed below this aperture is a horizontally extending shelf formed in the shell form on which a latch spring sits. This latch spring includes a notched latching piece for engagement with the cleaner when the bag lid door has hinged to closed position. Each of the actuator buttons has downwardly extending tabs with a pair of locking barbs disposed on oppositely situated tabs. To assemble the arrangement, the latch spring is placed on its shelf and the operator button inserted downwardly into its aperture and the locking barbs engaged. In one embodiment of the invention these locking barbs engage with the bag lid shell and in the other embodiment of the invention the locking barbs engage with the spring latch. In each embodiment the parts are then held in assembled relationship together.

BRIEF DESCRIPTION OF THE DRAWINGS

Reference may now be had to the accompanying Drawings for a better understanding of the invention, both as to its organization and function, with the illustration being of a pair of embodiments, but being only exemplary, and in which.

DETAILED DESCRIPTION OF THE INVENTION

Figure 1:
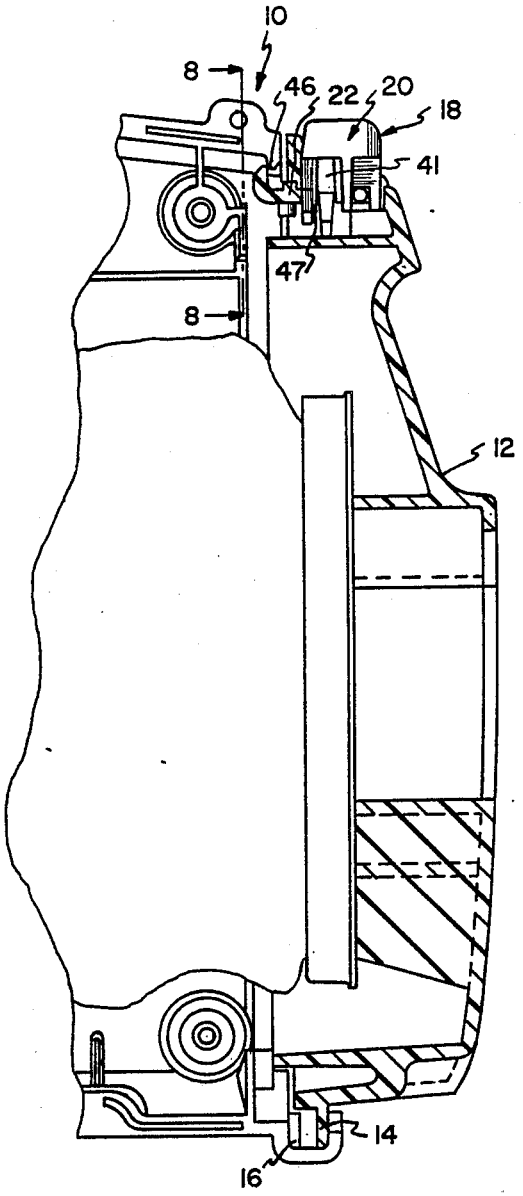
FIG. 1 is a partial cross sectional view of a cleaner and showing one form of latch in latched condition.
Figure 10:
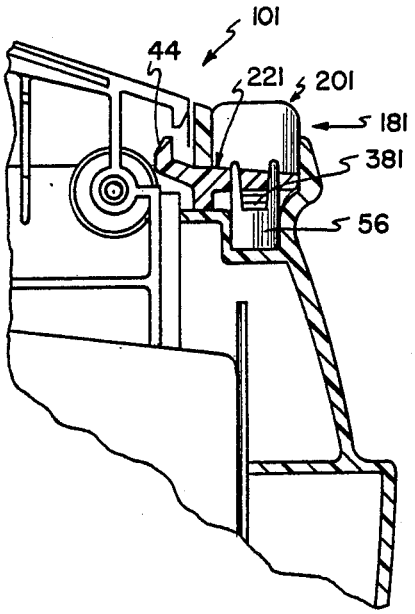
FIG. 10 is a somewhat more fragmentary view of the cleaner with the latch of the second embodiment disengaged.

There is shown in FIG. 1–8, the first embodiment of the invention and in which an axially extending cleaner 10 includes a bag lid door 12 pivoted to the cleaner 10 by an integral tab 14 that extends into a bottom notch 16 formed in the cleaner 10. A latch assembly 18 is disposed at the top of the bag lid door 12 to lockingly maintain it to the cleaner.

The latch assembly includes an operator button 20 and a latch spring 22 which interfit with the bag lid door 12 and each other to provide captivation for them in their assembled position. A downwardly open aperture 24 in the bag lid receives the operator button 20 while a shelf 26, integral with the bag lid 12, mounts the latch spring 22 between it and a rim 27 of bag lid door 12.

Operator button 20 has an operator contact portion 21 and takes the form of a downwardly open shell molding 28 which includes slotted end walls 30,30. These end walls each include a deep slot 32 and a generally parallel shallow slot 34. Disposed between these two slots is a narrow downwardly depending leg 36 that includes a locking barb 38. The slots 32 and 34 receive the latch spring 22 in a mounted position with transversely extending leaf like spring prongs, 40,40 of latch spring 22 being disposed in deep slots 32,32 and transversely extending trunnion pintle portions 42,42 of latch spring 22 being received in shallow slots 34,34. An elongated rib 41, disposed on the upper side of the latch spring 22 and aligned with spring prongs 40,40, also is received in deep slots 32,32 to prevent turning the latch spring 22 relative to operator button 20. Spring latch 22 also includes a latch portion 44, including a cam face 45, that engages behind an upper latching lip 46 formed integrally in the cleaner 10. A notch 47 in the back wall of latch operator button 20 nests this latch portion in assembled position. It also mounts a short rib 43 between the latch portion 44 and the spring prongs 40,40 which rests against the flanged rim of the bag lid door 12 so as to place the latch spring 22 in the proper position for latching engagement with the cleaner 10. The latch spring 22 also, incidentally, includes pins 51,51 that are necessary for ejection of this part from the mold in which it is made. They serve no real function in the latch arrangement described.

Figure 2:
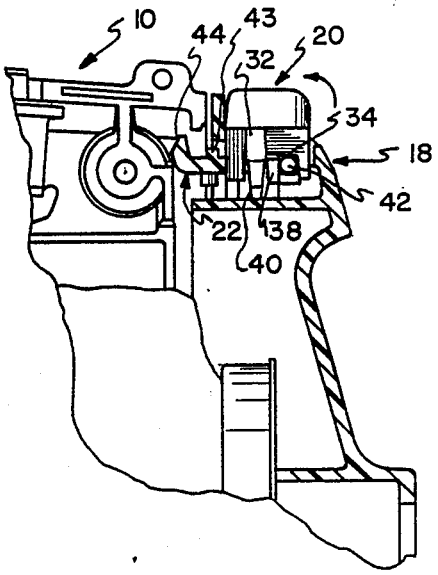
FIG. 2 is a somewhat more fragmentary view of the cleaner with this latch in unlatched condition.
Figure 11:
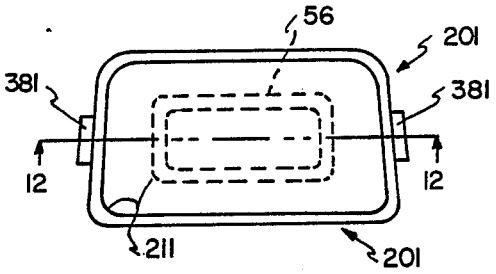
FIG. 11 is a plan view of the latch button of the second embodiment.
Figure 13:
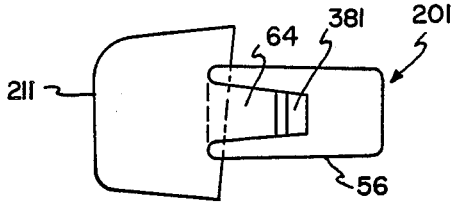
FIG. 13 is an end view of this button.
Figure 12:
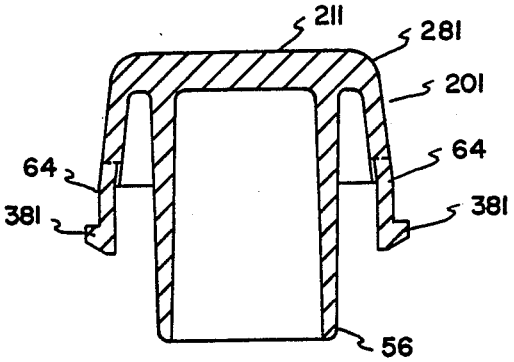
FIG. 12 is a cross sectional view of this button taken on line 12—12 of FIG. 11.
Figure 3:
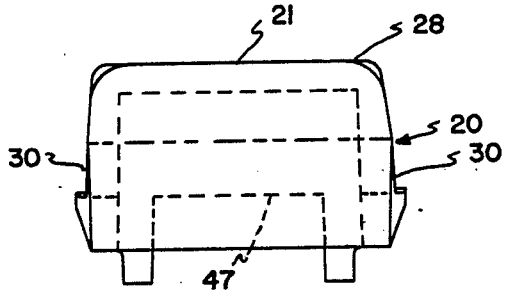
FIG. 3 is a front elevational view of the actuator button of the first embodiment.
Figure 4:
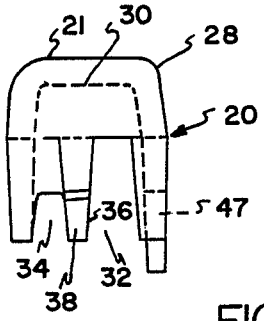
FIG. 4 is a side elevational view of this operator button.
Figure 5:
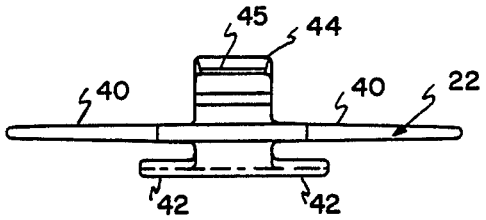
FIG. 5 is a plan view of the latch spring of the first embodiment.
Figure 6:
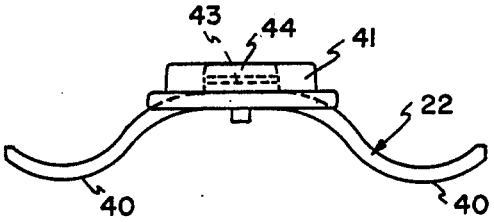
FIG. 6 is a front elevational view of the same latch spring.
Figure 7:
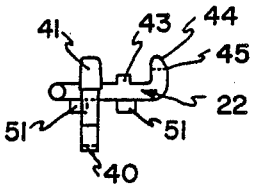
FIG. 7 is a side elevational view of the spring.
Figure 14:
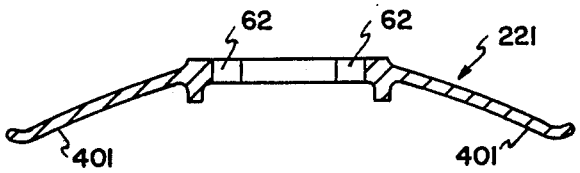
FIG. 14 is a cross sectional elevational view of the spring latch of the second embodiment.
Figure 15:
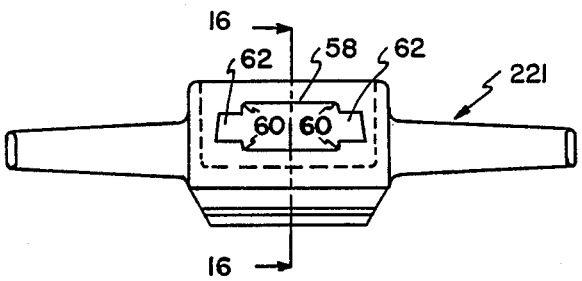
FIG. 15 is a plan view of this spring latch.
Figure 16:
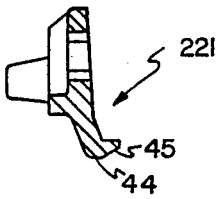
FIG. 16 is a cross sectional view of the spring latch of FIG. 15 taken in the direction of the line 16—16.
Figure 17:
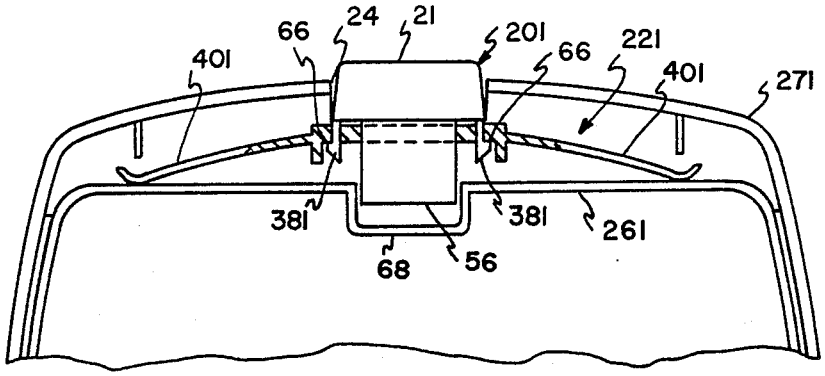
FIG. 17 is a cross sectional view of the second latch embodiment and looking in the direction of the line 17—17 in FIG. 9.
Figure 8:
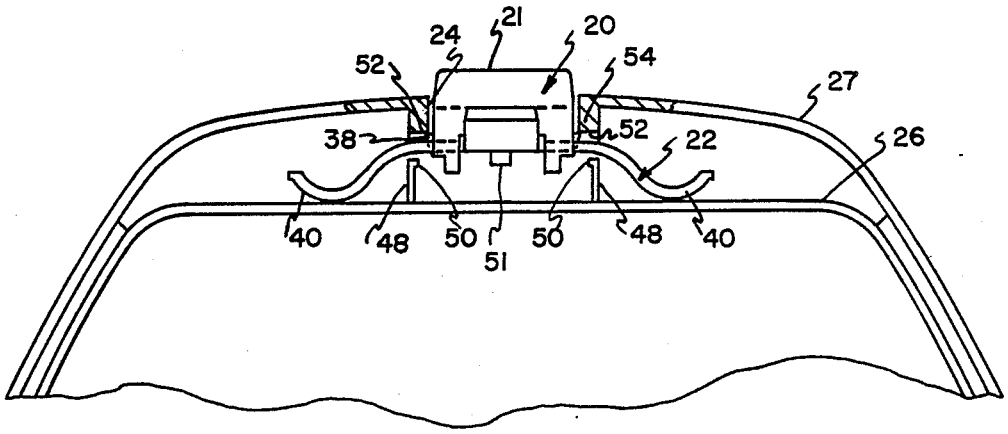
FIG. 8 is a view of the latch looking in the direction of the arrows 8—8 in FIG. 1.
Figure 9:
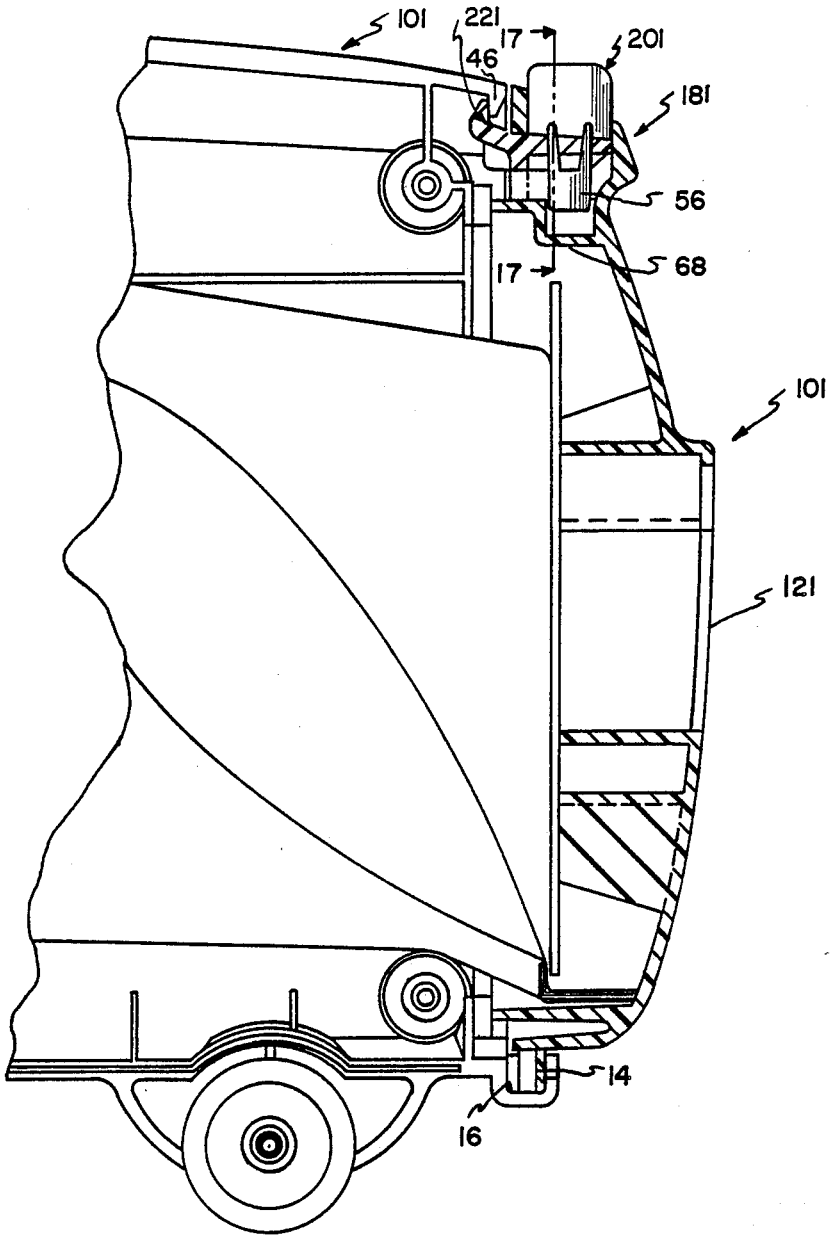
FIG. 9 is a partial cross sectional view of a cleaner showing the second and preferred embodiment of the invention with the latch engaged.

A pair of short upstanding ribs 48,48, integral with bag lid door 12, include inwardly extending tabs 50,50 that mount the trunnion pintle portions 42,42 of latch spring 22 when the same is slightly compressed to permit pivoting of it to unlatched position (FIG. 2). The spring prongs 40,40 abut shelf 26 and resiliently urge the latch spring 22 upwardly into locked condition.

The latch assembly 18 is easily mounted to the bag lid door 12. The latch spring 22 is first placed in the proper position on shelf 26, with the pintle portions 42,42 disposed above tabs 50. The latch operator button 20 is vertically inserted in the aperture 24 of bag lid door 12 with the slots 32,32 aligned with spring prongs 40,40 of latch spring 22 and with the slots 34,34 aligned with pintle portions 42,42 of latch spring 22. The latch operator button 22 is then depressed sufficiently to permit its locking barbs 38,38 to cammingly pass below edges 52,52 of an integral well 54 formed in bag lid door 12. The assembly is then complete and captivated and the latch assembly 18 can be easily locked by shutting the bag lid door 12, the latch assembly 18 reacting to the camming afforded by cam face 45 so that the latch portion 44 locks over cleaner latching lip 46.

The latch assembly 18 is unlocked by depressing latch operator button 20 which initially slightly compresses spring prongs 40,40 of latch spring 22 until pintle portions 42,42 of latch spring 22 bottom on tabs 50,50. The pintle portions 42,42 then pivot on these tabs because operator force on the latch operator button 20 is generally vertical, rearwardly of this pivot point. The latch spring 22 then swings clear of the latching lip 46 to permit opening of the bag lid door 12.

In the second and preferred embodiment of the invention, like numerals are utilized for like parts and numerals with a one added at their ends are utilized for altered parts.

A cleaner 101 is shown having a bag door 121 and a latch assembly 181. The latch assembly 181 includes a latch operator button 201 and a latch spring 221. As in the first embodiment, when assembled to the bag lid, the latch assembly is captivated therein.

Latch operator button 201 takes the form of a downwardly openin shell 281, with a hollow stem 56 that slideably mounts in a through hole 58 in latch spring 221. Through hole 58 is bordered, at its ends, by walls 60,60,60,60, with adjoining apertures 62,62 receiving a pair of locking barbs 381,381 integral with the latch operator button 201.

The locking barbs 381,381 are carried by a pair of downwardly depending integral arms 64,64, disposed on opposite sides of the latch operator button 20. The latch spring includes a latch portion 44 and sidewardly extending spring prongs 401,401.

The latch assembly 181 is mounted in the bag lid door 121 by placing the latch spring 221 on a shelf 261 provided in the bag lid door 121 and aligning the latch spring through hole 58 and apertures 62,62 with the inserted hollow stem 56 and arms 64,64 of the latch operating button 201 as it passes through aperture 26 in bag lid door 201. The latch operator button is pressed downwardly against the resilient action of the spring prongs 401,401 until the locking barbs 381,381 engage beneath edges 66,66 on the latch spring 221 to captivate the latch assembly 18 in the bag lid door 121.

A well 68 is provided in shelf 261 to afford guided movement of the hollow stem 56 of latch operator button 20 in its downward unlatching movement. This well also strengthens the latch assembly 181. Thus, rectilinear movement of the latch assembly 161 of the second, preferred embodiment affords unlocking of the bag lid door 121.

It should be obvious that many modifications can be made to the invention which still would fall within the spirit and purview of the description offered. It should also be obvious that the objects of the invention have been fully met by the structure described and that a pair of latch assemblies, easily mounted and securely held, have been obtained.

What is claimed is:

1. A cleaner bag lid latching arrangement including;
(a) a latch mounted in said bag lid,
(b) a latch operating button mounted in said bag lid,
(c) said operating button extending into said latch,
(d) one of said latch and said latch operating button having one way locking barbs, and
(e) said latching barbs fixing said latch and said latch operating button in assembled condition in said cleaner bag lid.

2. The cleaner bag lid latching arrangement of claim 1 wherein;
(a) said latch operating button is inserted through a vertically opening aperture in said bag lid for assembly with said latch and said bag lid.

3. The cleaner bag lid latching arrangement of claim 1 wherein;
(a) said latch includes resilient spring prongs, and
(b) said spring prongs abut vertically downwardly against a shelf in said bag lid when in assembled position.

4. The cleaner bag lid latching arrangement of claim 1 wherein;
(a) said latch includes leaf like spring portions for urging said latch into engaged position.

5. The cleaner bag lid latching arrangement of claim 1 wherein;
(a) said latch includes a central aperture and at least a sidewardly extending spring leaf, and
(b) said latch operating button extends into said aperture for assembly engagement of said locking barbs.

6. The cleaner bag lid latching arrangement of claim 1 wherein;
(a) said bag lid includes a shelf on its back side,
(b) said shelf providing a latch mounting slot between it and a rim on said cleaner bag lid, and
(c) said latch mounted in said slot.

7. The cleaner bag lid latching arrangement of claim 1 wherein;
(a) said locking barbs are mounted on said latch operating button.

8. The cleaner bag lid latching arrangement of claim 7 wherein;
(a) said barbs engage said bag lid for fixing said latch and said latch operating button in assembled condition with said cleaner bag lid.

9. The cleaner bag lid latching arrangement of claim 7 wherein;

(a) said barbs engage said latch for fixing said latch and said latch operating button in assembled condition with said cleaner bag lid.

10. The cleaner bag lid latching arrangement of claim 9 wherein;

(a) said latch operating button includes an extension, (b) said cleaner bag lid includes a well, and (c) said extension protrudes into said well.

* * * * *